US011396179B2

(12) United States Patent
Sugiura et al.

(10) Patent No.: US 11,396,179 B2
(45) Date of Patent: Jul. 26, 2022

(54) HEAD UNIT

(71) Applicant: BROTHER KOGYO KABUSHIKI KAISHA, Nagoya (JP)

(72) Inventors: Keita Sugiura, Toyokawa (JP); Atsushi Ito, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 51 days.

(21) Appl. No.: 17/113,650

(22) Filed: Dec. 7, 2020

(65) Prior Publication Data

US 2021/0178757 A1 Jun. 17, 2021

(30) Foreign Application Priority Data

Dec. 16, 2019 (JP) ..... JP2019-226447

(51) Int. Cl.
*B41J 2/14* (2006.01)
*B41J 2/045* (2006.01)

(52) U.S. Cl.
CPC ..... *B41J 2/14016* (2013.01); *B41J 2/04581* (2013.01); *B41J 2/14201* (2013.01)

(58) Field of Classification Search
CPC ..... B41J 2/14016; B41J 2/04581; B41J 2/14201; B41J 2/14233; B41J 2/175; B41J 29/13
See application file for complete search history.

(56) References Cited

U.S. PATENT DOCUMENTS

| | | | |
|---|---|---|---|
| 8,905,529 | B2 | 12/2014 | Watanabe et al. |
| 10,464,314 | B2 | 11/2019 | Ito et al. |
| 10,899,133 | B2 | 1/2021 | Nukui et al. |
| 11,046,072 | B2 | 6/2021 | Hori |
| 2013/0235131 | A1 | 9/2013 | Watanabe et al. |
| 2016/0297221 | A1 | 10/2016 | Kitazawa et al. |
| 2018/0339519 | A1 | 11/2018 | Katoh et al. |
| 2020/0307238 | A1 | 10/2020 | Kuno |

FOREIGN PATENT DOCUMENTS

| | | | |
|---|---|---|---|
| JP | H01-184151 | A | 7/1989 |
| JP | H05-76754 | U | 10/1993 |
| JP | H09-123488 | A | 5/1997 |
| JP | 2003-280101 | A | 10/2003 |
| JP | 2005-14469 | A | 1/2005 |
| JP | 2005-254619 | A | 9/2005 |

(Continued)

OTHER PUBLICATIONS

IP.com search (Year: 2022).*

(Continued)

*Primary Examiner* — Lisa Solomon
(74) *Attorney, Agent, or Firm* — Scully, Scott, Murphy & Pressser, PC

(57) ABSTRACT

There is provided a head unit including: head modules; a plurality of first tubes; and a plurality of second tubes. Each of the head modules includes: energy-applying mechanisms; supply buffer chambers; and return buffer chambers. The supply buffer chambers of the plurality of head module are connected in series via the plurality of first tubes. The return buffer chambers of the plurality of head modules are connected in series via the plurality of second tubes.

11 Claims, 8 Drawing Sheets

(56) References Cited

FOREIGN PATENT DOCUMENTS

| | | | | |
|---|---|---|---|---|
| JP | 2009-285900 | A | | 12/2009 |
| JP | 2011-212915 | A | | 10/2011 |
| JP | 2013-216077 | A | | 10/2013 |
| JP | 2015-214130 | A | | 12/2015 |
| JP | 2016179654 | A | * | 10/2016 |
| JP | 2018-199326 | A | | 12/2018 |

OTHER PUBLICATIONS

Related U.S. Appl. No. 17/113,688, filed Dec. 7, 2020.
Related U.S. Appl. No. 17/113,729, filed Dec. 7, 2020.
Notice of Allowance dated Sep. 27, 2021 from related U.S. Appl. No. 17/113,688.
Notice of Allowance dated Oct. 19, 2021 from related U.S. Appl. No. 17/113,729.

* cited by examiner

HEAD UNIT

CROSS REFERENCE TO RELATED APPLICATION

The present application claims priority from Japanese Patent Application No. 2019-226447, filed on Dec. 16, 2019, the disclosure of which is incorporated herein by reference in its entirety.

BACKGROUND

Field of the Invention

The present disclosure relates to a head unit having a buffer chamber.

Description of the Related Art

There is a publicly known print head of a line type having a plurality of recording heads arranged in a row. In this print head, the plurality of recording heads are provided with tanks, respectively, each of which is called a head tank and each of which temporarily stores an ink. The head tanks are provided with discharge ports and supply ports, respectively. The discharge ports of head tanks, which are included in the head tanks and which are adjacent to each other are connected to each other, and the supply ports of the adjacent head tanks are connected to each other.

SUMMARY

In the above-described print head, since both of the discharge ports and the supply ports provided in the head tanks, respectively, extend vertically upward, tubes connected to the discharge ports and the supply ports are connected thereto vertically upward. This leads to an increase in the size in the vertical direction of the print head.

The present disclosure has been made in view of the circumstances described above, and one of the objects thereof is to provide a means for achieving a miniaturization of a head unit by improving the space-efficiency of tanks arranged inside the head unit and tubes connected to the tanks.

According to a first aspect of the present disclosure, there is provided a head unit including: a plurality of head modules each including: channel units each including a pressure chamber, a nozzle communicating with the pressure chamber, and a channel communicating with the pressure chamber; energy-applying mechanisms, each of the energy-applying mechanisms being configured to apply a discharge pressure to a liquid in the pressure chamber of one of the channel units; supply buffer chambers, each of the supply buffer chambers being configured to temporarily store the liquid which is to be supplied to one of the channel units, and each of the supply buffer chambers including two ports; and return buffer chambers, each of the return buffer chambers being configured to temporarily store the liquid which is discharged from one of the channel units, and each of the return buffer chambers including two ports; a plurality of first tubes connected to the ports of the supply buffer chambers, respectively; and a plurality of second tubes connected to the ports of the return buffer chambers, respectively. The supply buffer chambers of the plurality of head module are connected in series via the plurality of first tubes. The return buffer chambers of the plurality of head modules are connected in series via the plurality of second tubes.

According to a second aspect of the present disclosure, there is provided a head unit including: a plurality of head modules arranged side by side in a first direction orthogonal to a vertical direction, each of the plurality of head modules including: channel units each including a pressure chamber, a nozzle communicating with the pressure chamber, and a channel communicating with the pressure chamber; energy-applying mechanisms, each of the energy-applying mechanisms being configured to apply a discharge pressure to a liquid in the pressure chamber of one of the channel units; supply buffer chambers, each of the supply buffer chambers being configured to temporarily store a liquid which is to be supplied to one of the channel units, and each of the supply buffer chambers including two ports; and return buffer chambers, each of the return buffer chambers being configured to temporarily store the liquid which is discharged from one of the channel units, and each of the return buffer chambers including two ports; a plurality of first tubes connected to the ports of the supply buffer chambers, respectively; and a plurality of second tubes connected to the ports of the return buffer chambers, respectively. Each of the supply buffer chambers includes two side surfaces orthogonal to the first direction, and the two ports are arranged at upper parts in the vertical direction of the two side surfaces, respectively. Each of the return buffer chambers includes two side surfaces orthogonal to the first direction, and the two ports are arranged at upper parts in the vertical direction of the two side surfaces, respectively.

DESCRIPTION OF THE EMBODIMENTS

In the following, a printer 10 according to an embodiment of the present disclosure will be described. Note that the embodiment which is to be explained below is merely an example of the present disclosure; it is needless to say that the embodiment can be appropriately changed without changing the gist of the present disclosure. Further, in the following explanation, advancement or movement (progress) directed from a starting point to an end point of an arrow is expressed as an "orientation", and going forth and back on a line connecting the starting point and the end point of the arrow is expressed as a "direction". Further, in the following explanation, the up-down direction is defined, with a state in which the printer 10 is installed usably (a state of FIG. 1) as the reference; the front-rear direction is defined, with a side on which a discharge port 13 is provided is defined as a front side (front surface); and the left-right direction is defined, with the printer 10 as seen from the front side (front surface).

<Outer Configuration of Printer 10>

Figure 1:
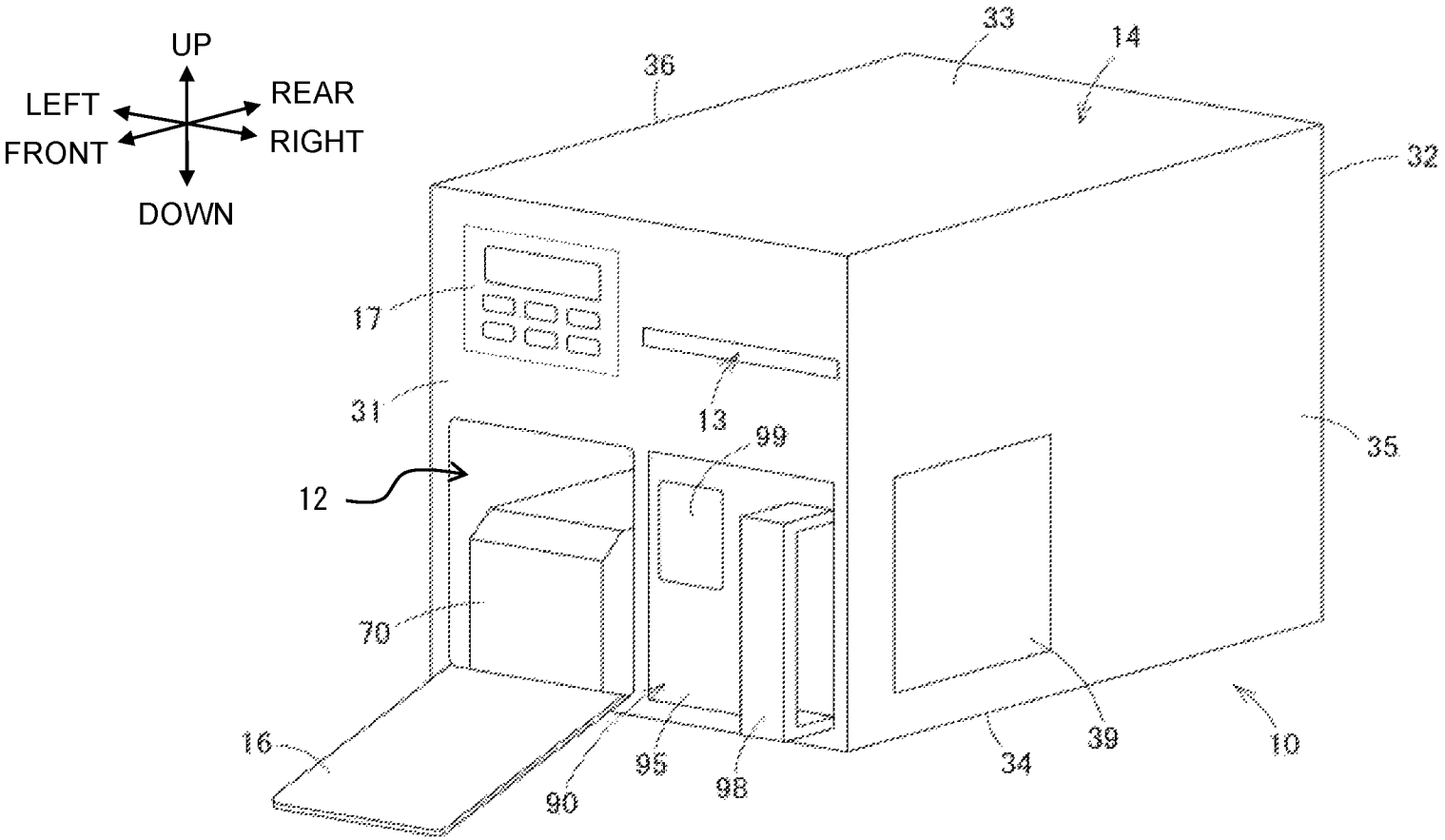
FIG. 1 is a perspective view of a printer 10 in a state that a cover 16 is opened.

As depicted in FIG. 1, the printer 10 records an image on a roll body 11 (see FIG. 2), etc., in the ink-jet recording system. A casing 14 of the printer 10 has a substantially rectangular parallelepiped shape of which internal space is defined or partitioned by walls. The casing 14 has: a right wall 35 and a left wall 36 located apart from each other in the left-right direction; an upper wall 33 and a lower wall 34 located apart from each other in the up-down direction, and connecting the right wall 35 and the left wall 36 to each other; and a front wall 31 and a rear wall 32 located apart from each other in the front-rear direction, and connecting the upper wall 33 and the lower wall 34 to each other.

The casing 14 has a size placable or arrangable on a table or desk. That is, the printer 10 is suitable to be used by being placed on the table or desk. Of course, the printer 10 may be used while being placed on a floor surface.

The front wall 31 of the casing 14 has a discharge port 13 formed in the front wall 31, penetrating through the front wall 31 and communicating with the inner space. The discharge port 13 is located at an upper right part of the front wall 31. An operation panel 17 (an example of an "input part") is located in the front wall 31 at a location left to the discharge port 13. The operation panel 17 includes, for example, a display, an input key, etc. A user performs input, via the operation panel 17, for operating the printer 10 or for confirming a variety of kinds of settings.

A cover 16 is provided in the front wall 31, at a location below the operation panel 17. As depicted in FIG. 1, the cover 16 is opened by rotating about a rotational axis along the left-right direction at a lower end of the cover 16. In a case that the cover 16 is opened, the inner space of the casing 14 is exposed via an opening 12. A main tank 70 is positioned at a location behind or on the rear side of the cover 16. An ink is stored in the main tank 70. The main tank 70 is of a cartridge type which is attachable and removable with respect to the casing 14. The ink is supplied from the main tank 70 through a non-illustrated tube to the print head 24 (see FIG. 2).

The ink is a liquid containing a pigment, etc. The ink has a viscosity suitable for uniformly dispersing the pigment. The pigment is a component which serves as the color of the ink.

As depicted in FIG. 1, a holder 90 which holds the roll body 11 is inserted into the front wall 31 at a location on the right side of the cover 16. The holder 90 is provided with a handle 98. For example, in a case of replacing the roll body 11, etc., the user can grasp the handle 98 and pull the holder 90 frontward in the front-rear direction.

The right wall 35 is provided with a window 39. The window 39 is a translucent member which closes a through hole penetrating through the right wall 35. The window 39 is provided for visually observing the roll body 11 located in the inner space of the casing 14, from the outside of the casing 14.

<Holder 90>

Figure 2:
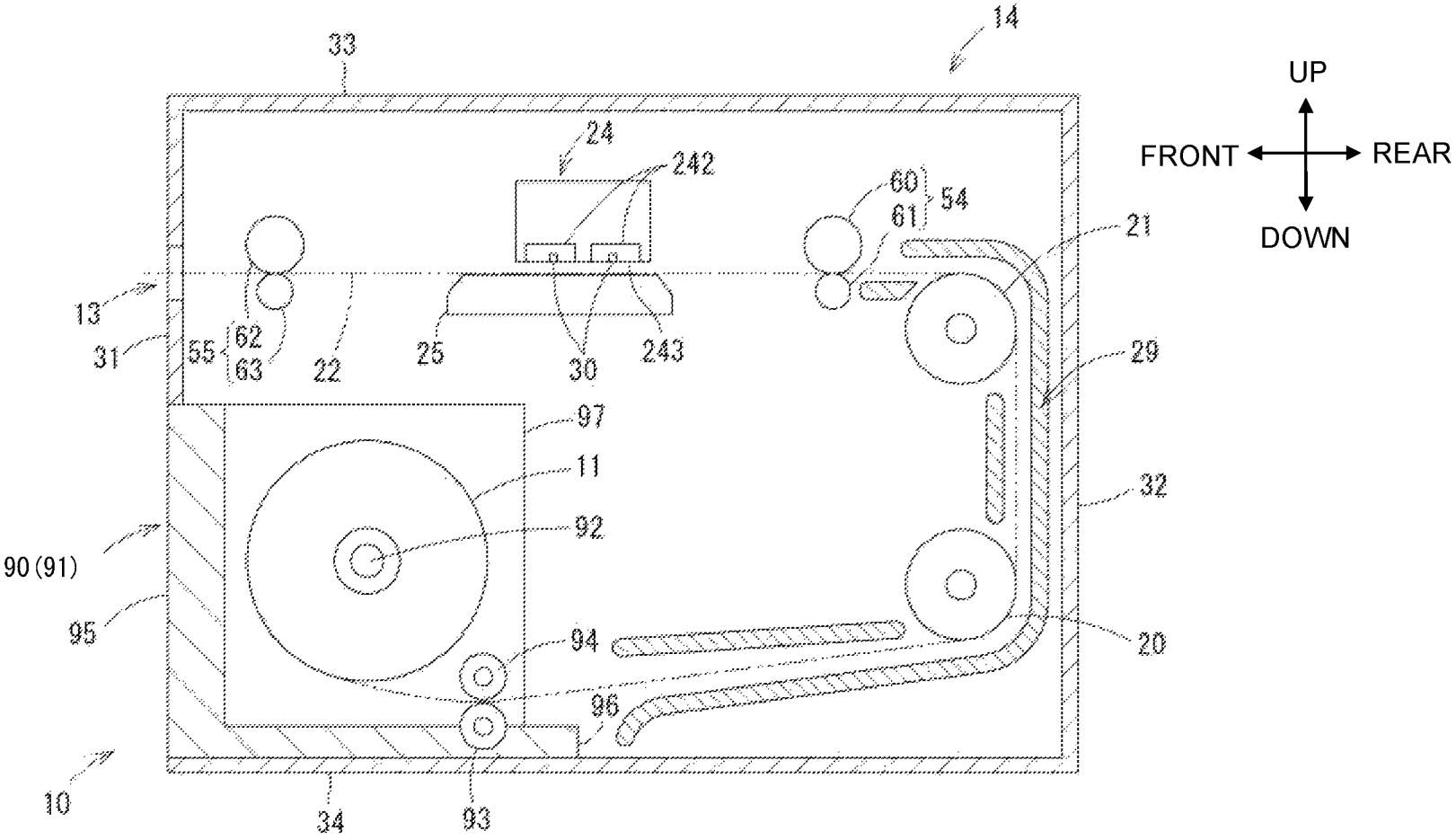
FIG. 2 is a schematic view depicting the inner structure of the printer 10.

As depicted in FIG. 2, the holder 90 has a holder casing 91, a spindle 92, and nip rollers 93 and 94. The holder casing 91 has a holder front wall 95, a holder lower wall 96, and a holder side wall 97. The holder side wall 97 is provided with the spindle 92 extending along the left-right direction. The spindle 92 supports the roll body 11. The spindle 92 is rotated by the rotation transmitted from a motor (not depicted in the drawings) located in the inner space of the casing 14. Accompanying with the rotation of the spindle 92, the roll body 11 supported by the spindle 92 also rotates. The nip roller 93 is provided on the holder lower wall 96, and the nip roller 94 is provided at a location above the nip roller 93. A sheet drawn from the roll body 11 supported by the spindle 92 passes between the nip rollers 93 and 94. The nip roller 93 is subjected to the drive transmittance from the motor (not depicted in the drawings) located in the inner space of the casing 14. In this situation, the sheet sandwiched between the nip rollers 93 and 94 is fed backward toward a conveyance path 22 (to be described later on).

<Inner Configuration of Printer 10>

As depicted in FIG. 2, guide rollers 20 and 21, a first conveying roller pair 54, a second conveying roller pair 55, the print head 24 (correspondence to a "head unit" of the present disclosure), a platen 25, and the main tank 70 are arranged in the inner space of the casing 14. Although not depicted in FIG. 2, it is allowable that other members such as: a maintenance unit such as a cap which covers a nozzle surface of the print head 24, a wiper which wipes the nozzle surface, etc., a control board, a power source circuit, etc., may be arranged in the inner space of the casing 14.

Figure 3:
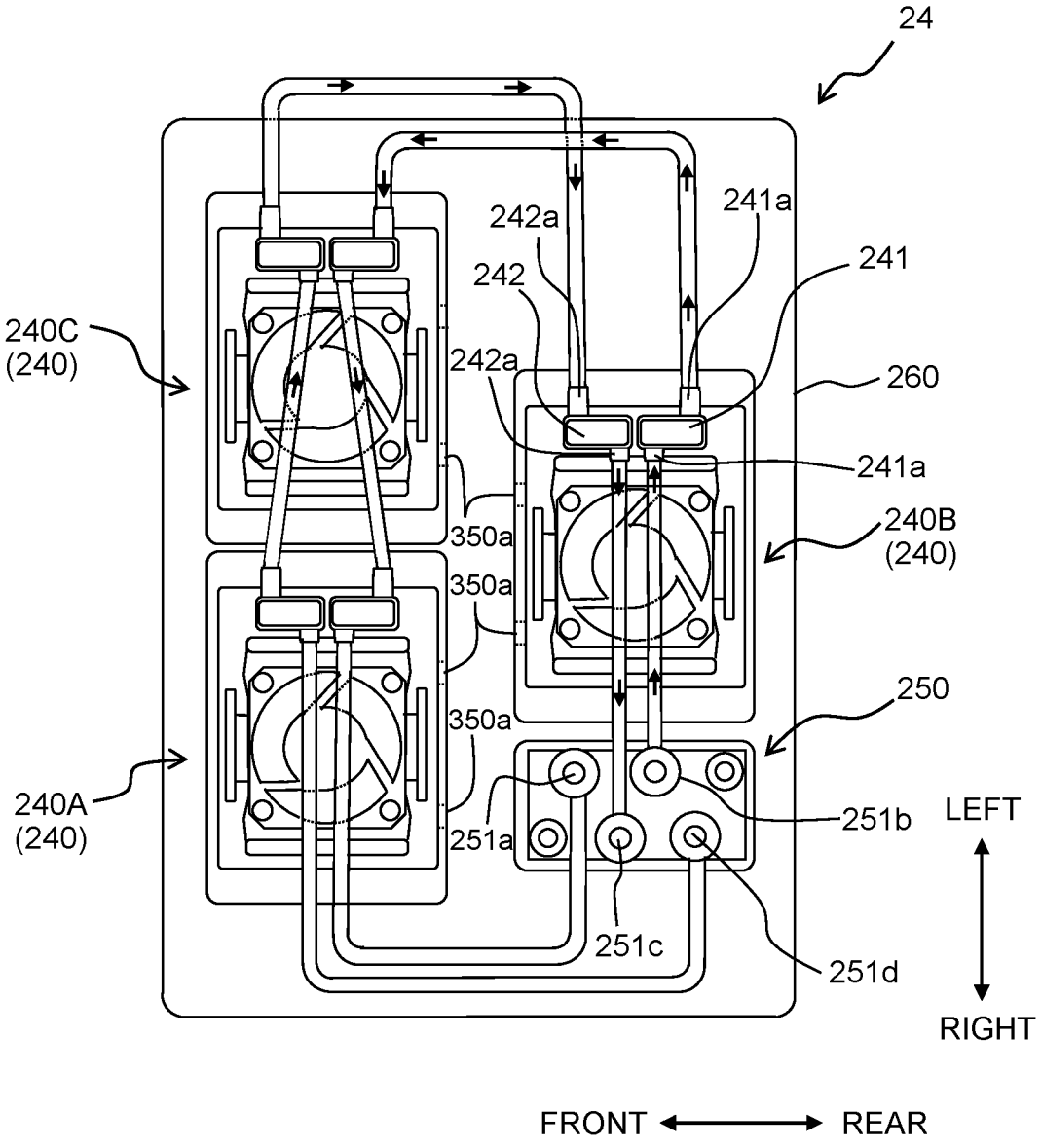
FIG. 3 is a schematic view of a print head 24.

The print head 24 is provided with three head modules 240A, 240B and 240C (see FIG. 3). As will be described later, the three head modules 240A, 240B and 240C have a same structure, and are collectively referred to as head modules 240, in some cases. In each of the head modules 240, a plurality of nozzles 30 are arranged side by side in the left-right direction. From the plurality of nozzles 30, ink droplets of the ink are discharged or ejected downward toward the platen 25. The configurations of the print head 24 and the head modules 240 will be described in detail later.

<Conveyance Path 22>

As depicted in FIG. 2, a conveyance path 22 is formed to extend from a location in the vicinity of a rear end of the holder 90, then to the guide roller 20, the guide roller 21, and up to the discharge port 13. The conveyance path 22 is curved in a range or area from the location in the vicinity of the rear end of the holder 90 up to the guide roller 21. Between the guide roller 21 and the discharge port 13, the conveyance path 22 extends substantially linearly along the front-rear direction. The conveyance path 22 is defined by guide members which are located to be away from each other in the up-down direction, the guide roller 21, the print head 24, the platen 25, etc. In the conveyance path 22 at a part thereof between the guide roller 21 and the discharge port 13, the forward orientation is a conveyance orientation.

As depicted in FIG. 2, the first conveying roller pair 54 is provided on the conveyance path 22, on the upstream side of the print head 24 in the conveyance orientation. The first conveying roller pair 54 includes a first conveying roller 60 and a pinch roller 61. The second conveying roller pair 55 is provided on the conveyance path 22, on the downstream side of the print head 24 in the conveyance orientation. The second conveying roller pair 55 has a second conveying roller 62 and a pinch roller 63. The first conveying roller 60 and the second conveying roller 62 are rotated by the rotation transmitted thereto by the motor (not depicted in the drawings). The pinch roller 61 is urged toward the first conveying roller 60. The pinch roller 63 is urged toward the second conveying roller 62. The first conveying roller pair 54 and the second conveying roller pair 55 convey the sheet in the conveyance orientation by rotations of the first conveying roller 60 and the second conveying roller 62 in a state that the sheet extending from the roll body 11 is held or pinched between the respective rollers constructing the first and second conveying roller pairs 54 and 55.

As depicted in FIG. 2, the print head 24 and the platen 25 are located in the conveyance path 22 at a part thereof between the first conveying roller pair 54 and the second conveying roller pair 55.

As depicted in FIG. 2, the platen 25 is positioned at a location below the print head 24. The upper surface of the platen 25 is parallel to a plane in which each of the plurality of nozzles 30 of the print head 24 are opened. The size along the left-right direction of the upper surface of the platen 25 is greater than the size along the left-right direction of the roll body 11. The platen 25 supports, on the upper surface thereof, the sheet conveyed by the first conveying roller pair 54 and the second conveying roller pair 55. Although not depicted in FIG. 2, it is allowable that the sheet is attracted to the upper surface of the platens 25 by negative pressure or static electricity. Since the platen 25 is not attached to the holder 90, even if the holder 90 is pulled out from the casing 14, the platen 25 is located in the inner space of the housing 14 without moving.

<Operation of Printer 10>

In the following, an image recording operation by the printer 10 will be explained. The printer 10 which receives print data controls the motor (not depicted in the drawings) so as to rotate the spindle 92, the nip roller 93, the guide rollers 20 and 21, the first conveying roller 60 and the second conveying roller 62. As a result, a forward end of the sheet of the roll body 11 is fed out to a location below or under the print head 24. The fed sheet of the roll body 11 faces or is opposite to the printer head 24 at a surface, of the sheet, which is oriented radially outward in the roll. Then, the printer 10 discharges the ink from the print head 24 toward the sheet based on the print data while rotating the respective rollers. The ink droplets of the ink discharged from the print head 24 adhere to the sheet supported by the platen 25.

In a case that the printer 10 determines that the printing based on the print data has been completed, the printer, according to this determination, causes the sheet to be conveyed until a part, of the sheet pulled out from the roll body 11, on which the printing has been performed is conveyed from the discharge port 13 to the outside of the casing 14, and then controls the motor (not depicted in the drawings) so as to stop the rotations of the spindle 92, the nip roller 93, the guide rollers 20 and 21, the first conveying roller 60 and the second conveying roller 62.

<Print Head 24>

In the following, the flow of the ink in the print head 24 will be firstly explained, with reference to FIGS. 3 and 4, and then the construction of the head modules 240 will be explained.

<Flow of Ink in Print Head 24>

As depicted in FIG. 3, the print head 24 includes the three head modules 240A, 240B and 240C, a joint unit 250, and a support substrate 260. Note that the three head modules 240A to 240C have the same configuration, and are collectively referred to as the head modules 240 unless the three head modules 240A to 240C are to be distinguished from one another. The support substrate 260 is a substantially rectangular plate-shaped member, and three opening are formed (not depicted in the drawings) therein. Each of the three head modules 240 is attached to one of the three openings (not depicted in the drawings). At a location on the front side of the support substrate 260, the two head modules 240A and 240C are arranged in the left-right direction. The head module 240B is arranged between the two head modules 240A and 240C in the left-right direction, at a location on the rear side of the support substrate 260.

The joint unit 250 is arranged at a location which is on the rear side or behind the head module 240A and on the right side of the head module 240B. As described above, since the head module 240B is arranged between the two head modules 240A and 240C in the left-right direction, at the location on the rear side of the support substrate 260, a right end of the head module 240B is positioned to be shifted to the left side from a right end of the head module 240A. The joint unit 250 is arranged in a space or gap behind the right end of the head module 240A. Although not depicted in FIG. 3, a sub tank SBT (see FIG. 4, correspondence to a "tank" of the present disclosure) is arranged at a location below the joint unit 250. The sub tank SBT is connected to the main tank 70 via a non-illustrated tube and a non-illustrated pump, and temporarily stores the ink supplied from the main tank 70 to the print head 24.

Figure 4:
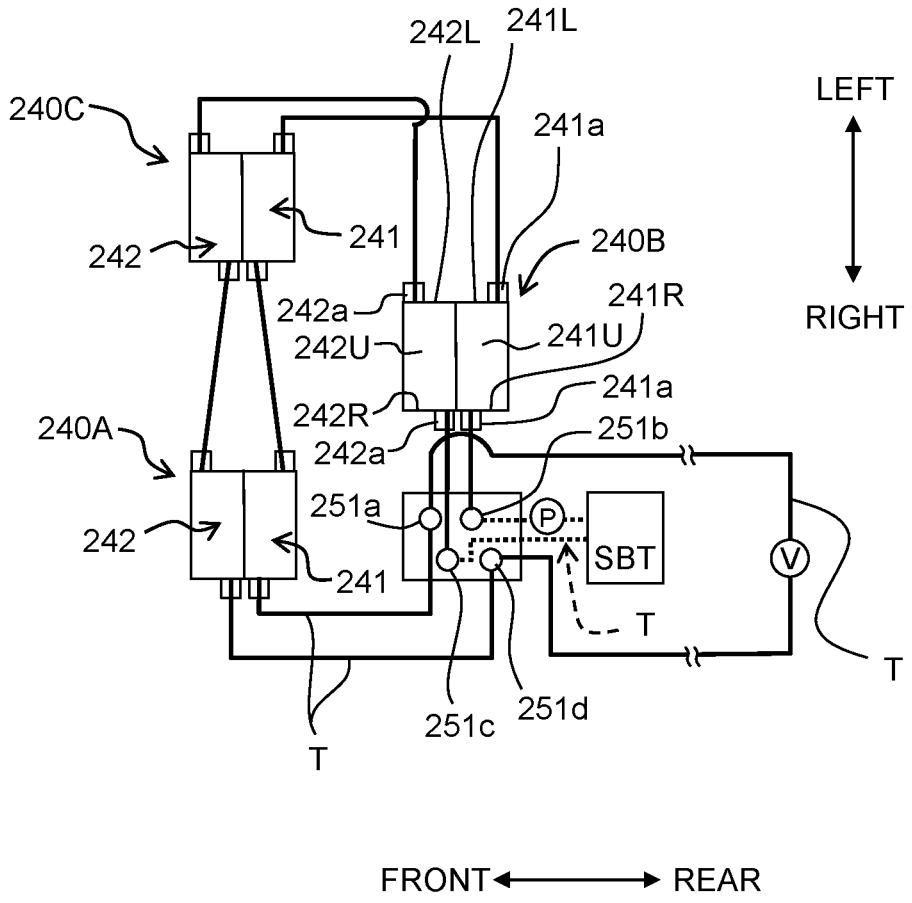
FIG. 4 is a schematic view for explaining a circulation path or route of an ink.

As depicted in FIGS. 3 and 4, the joint unit 250 has four joints 251*a* to 251*d*. The four joints 251*a* to 251*d* have a same structure, but are arranged in different positions from one another. In a case that the positions at which the four joints 251*a* to 251*d* are arranged, respectively, are not an issue, the four joints 251*a* to 251*d* are collectively referred to as joints 251. The joint 251*a* is arranged on the front side of the joint 251*b*, and the joint 251*c* is arranged on the front side of the joint 251*d*. Further, the two joints 251*a* and 251*b* are arranged on the left side of the two joints 251*c* and 251*d*.

Figure 5:
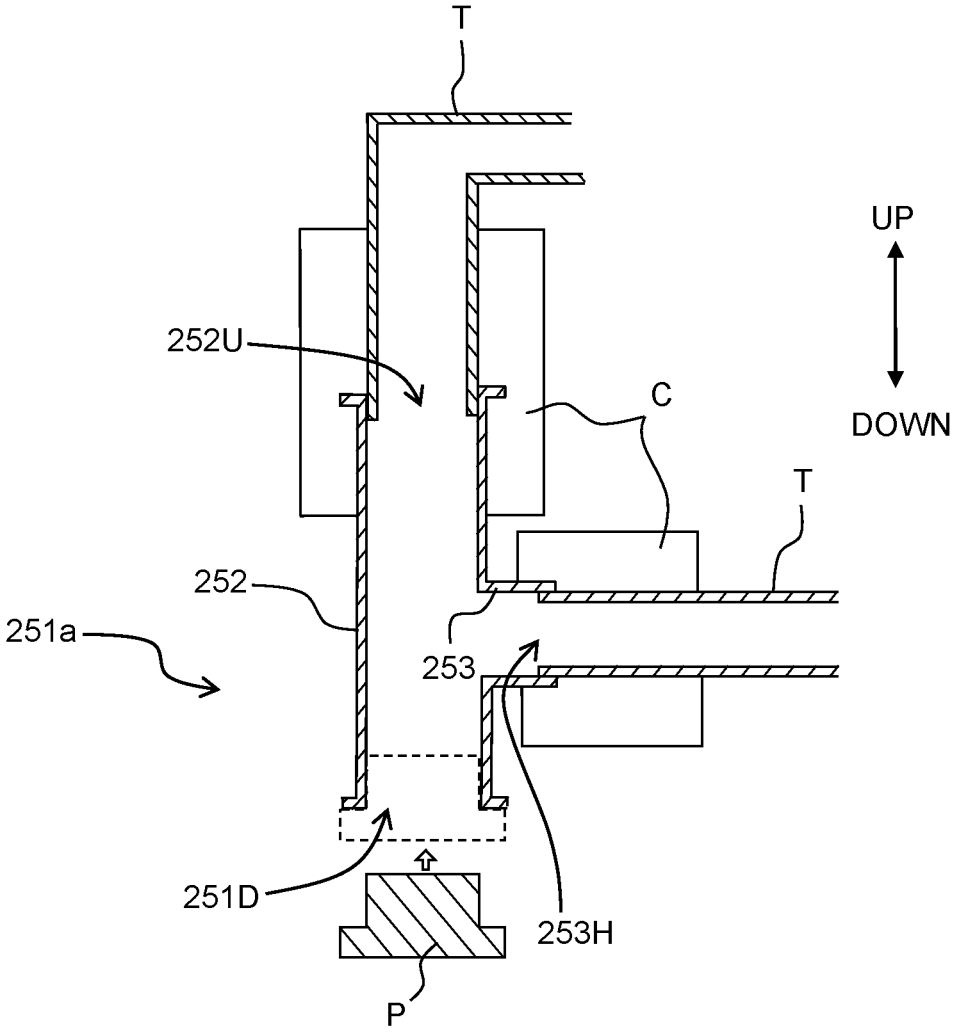
FIG. 5 is a schematic view depicting a cross section of a joint 251*a*.

Next, the shapes of the joints 251*a* to 251*d* will be explained, with reference to FIG. 5. Note that since all of these four joints 251*a* to 251*d* have the same shape, the following explanation will be made with the joint 251*a* as an example. The joint 251*a* has a first cylindrical part 252 extending in the up-down direction and a second cylindrical part 253 branched in the horizontal direction from the first cylindrical part 252. Openings 252U and 252D are formed at an upper end and a lower end, respectively, of the first cylindrical part 252. The opening 252U is opened upward and the opening 252D is opened downward. That is, the normal directions of the opening 252U and 252D are both parallel to the up-down direction. An opening 253H is formed at a forward end of the second cylindrical part 253. The opening 253H is oriented in the horizontal direction. That is, the normal direction of the opening 253H is parallel to the horizontal direction.

A tube T is fitted into the opening 252U located on the upper end of the first cylindrical part 252, and is fixed thereto by a fixing connector C. Note that the tube T can be similarly fitted to each of the opening 252D located on the lower end of the first cylindrical part 252 and to the opening 253H located at the forward end of the second cylindrical part 253, and can be fixed thereto by the fixing connector C. Note that in a case that the tube T is not connected, a plug P may be fitted to and may seal the opening 252D or the opening 253H as depicted in FIG. 5. Note that in each of the joint 251*b* and the joint 251*c*, the opening 253H at the forward end of the second cylindrical part 253 is sealed with the plug P, and the tube T is fitted to the opening 252D at the lower end of the first cylindrical part 252, and each of the joint 251*b* and the joint 251*c* is communicated with the sub tank SBT (see FIG. 4) via the tube T. Note that in FIG. 4, for the purpose of simplifying the drawing, the sub tank SBT is arranged behind the joint unit 250 (joints 251*b* and 251*c*) and the tubes T extend rearwardly. Actually, however, the sub tank SBT is arranged below the joint unit 250 (joints 251*b* and 251*c*), and the tube T fitted to the opening 252D at the lower end of the first cylindrical part 252 of each of the joints 251*b* and 251*c* extends downward. The tubes T connecting the joints 251*b* and 251*c* and the sub tank SBT correspond to "first tubes" of the present disclosure. Further, in each of the joint 251*a* and the joint 251*d*, the opening 252D at the lower end of the first cylindrical part 252 is sealed with the plug P, and the tube T is fitted into the opening 253H at the forward end of the second cylindrical part 253, and each of the joints 251*a* and 251*d* is communicated with a valve V (see FIG. 4) via the tube T. That is, the joint 251*a* and the joint 251*d* communicate with each other via the valve V. The tube T connecting the joints 251*a* and 251*d* and the valve V corresponds to a "third tube" of the present disclosure. As will be described later, in all of the joints 251*a* to 251*d*, the tube T is fitted to the opening 242U at the upper end of the first cylindrical part 252, and each of the joints 251*a* to 251*d* communicates with a supply buffer chamber 241 or a return buffer chamber 242 (which will be described later on), via the tube T. The tubes T connecting the joints 251*a* to 251*d* and the supply buffer chamber 241 (or the return buffer chamber 242) correspond to "second tubes" of the present disclosure.

As depicted in FIGS. 3 and 4, each of the head modules 240 includes a supply buffer chamber 241 and a return buffer chamber 242. Each of the supply buffer chamber 241 and the return buffer chamber 242 has a substantially rectangular parallelepiped shape. Note that a top surface 241U of the supply buffer chamber 241 and a top surface 242U of the return buffer chamber 242 are formed of a member which is deformable by the dynamic pressure of the ink flowing in the supply buffer chamber 241 and the return buffer chamber 242. For example, the top surface 241U of the supply buffer chamber 241 and the top surface 242U of the return buffer chamber 242 can be formed by attaching a resin film to each of the supply buffer chamber 241 and the return buffer chamber 242. The supply buffer chamber 241 has two ports 241*a* for the ink; each of the two ports 241*a* is arranged on one of a left side surface 241L and a right side surface 241R of the supply buffer chamber 241. The port 241*a* provided on the left side surface 241L of the supply buffer chamber 241 is arranged at a location behind the center in the front-rear direction of the left side surface 241L, and the port 241*a* provided on the right side surface 241R of the supply buffer chamber 241 is arranged at a location in front of the center in the front-rear direction of the right side surface 241R. That is, the two ports 241*a* are arranged at positions diagonal to each other in the left side surface 241L and the right side surface 241R. Similarly, the return buffer chamber 242 has two ports 242*a* for the ink; each of the two ports 242*a* is arranged on one of a left side surface 242L and a right side surface 242R of the return buffer chamber 242. The port 242*a* provided on the left side surface 242L of the return buffer chamber 242 is arranged at a location in front of the center in the front-rear direction of the left side surface 242L, and the port 242*a* provided on the right side surface 242R of the return buffer chamber 242 is arranged at a location behind the center in the front-rear direction of the right side surface 242R. That is, the two ports 242*a* are arranged at positions diagonal to each other in the left side surface 242L and the right side surface 242R.

As depicted in FIG. 4, the joint 251*b* is connected to the sub tank SBT. Further, as depicted in FIGS. 3 and 4, the joint 251*b* and the port 241*a* arranged on the right side surfaces 241R of the supply buffer chamber 241 of the head module 240B are connected via the tube T. The port 241*a* arranged on the left side surface 241L of the supply buffer chamber 241 of the head module 240B and the port 241*a* arranged on the left side surface 241L of the supply buffer chamber 241 of the head module 240C are connected via the tube T. The port 241*a* arranged on the right side surface 241R of the supply buffer chamber 241 of the head module 240C and the port 241*a* arranged on the left side surface 241L of the supply buffer chamber 241 of the head module 240A are connected via the tube T. Further, the port 241*a* arranged on the right side surface 241R of the supply buffer chamber 241 of the head module 240A and the joint 251*a* are connected via the tube T. As described above, the sub tank SBT, the joint 251*b*, the supply buffer chambers 241 of the three head modules 240, and the joint 251*a* are connected via the tubes T. This is called as a supply ink path.

As depicted in FIGS. 3 and 4, the joint 251*d* and the port 242*a* arranged on the right side surfaces 242R of the return buffer chamber 242 of the head module 240A are connected via the tube T. The port 242*a* arranged on the left side surface 242L of the return buffer chamber 242 of the head module 240A and the port 242*a* arranged on the right side surface 242R of the return buffer chamber 242 of the head module 240C are connected via the tube T. The port 242*a* arranged on the left side surface 242L of the return buffer chamber 242 of the head module 240C and the port 242*a* arranged on the left side surface 242L of the return buffer chamber 242 of the head module 240B are connected via the tube T. Further, the port 242*a* arranged on the right side surface 242R of the return buffer chamber 242 of the head module 240B and the joint 251*c* are connected via the tube T. Furthermore, as depicted in FIG. 4, the joint 251*c* and the sub tank SBT are connected via the tube T. As described above, the joint 251*d*, the return buffer chambers 242 of the three head modules 240, the joint 251*c*, and the sub tank SBT are connected via the tubes T. This is called as a return ink path.

Moreover, as described above, the joints 251*a* and 251*d* are connected by the tube T via the valve V arranged at the outside of the print head 24 (see FIG. 4). This creates an ink circulation path via which the ink from the sub tank SBT passes the supply ink path, the valve V and the return ink path and returns to the sub tank SBT.

<Structure of Head Module 240>

Figure 6:
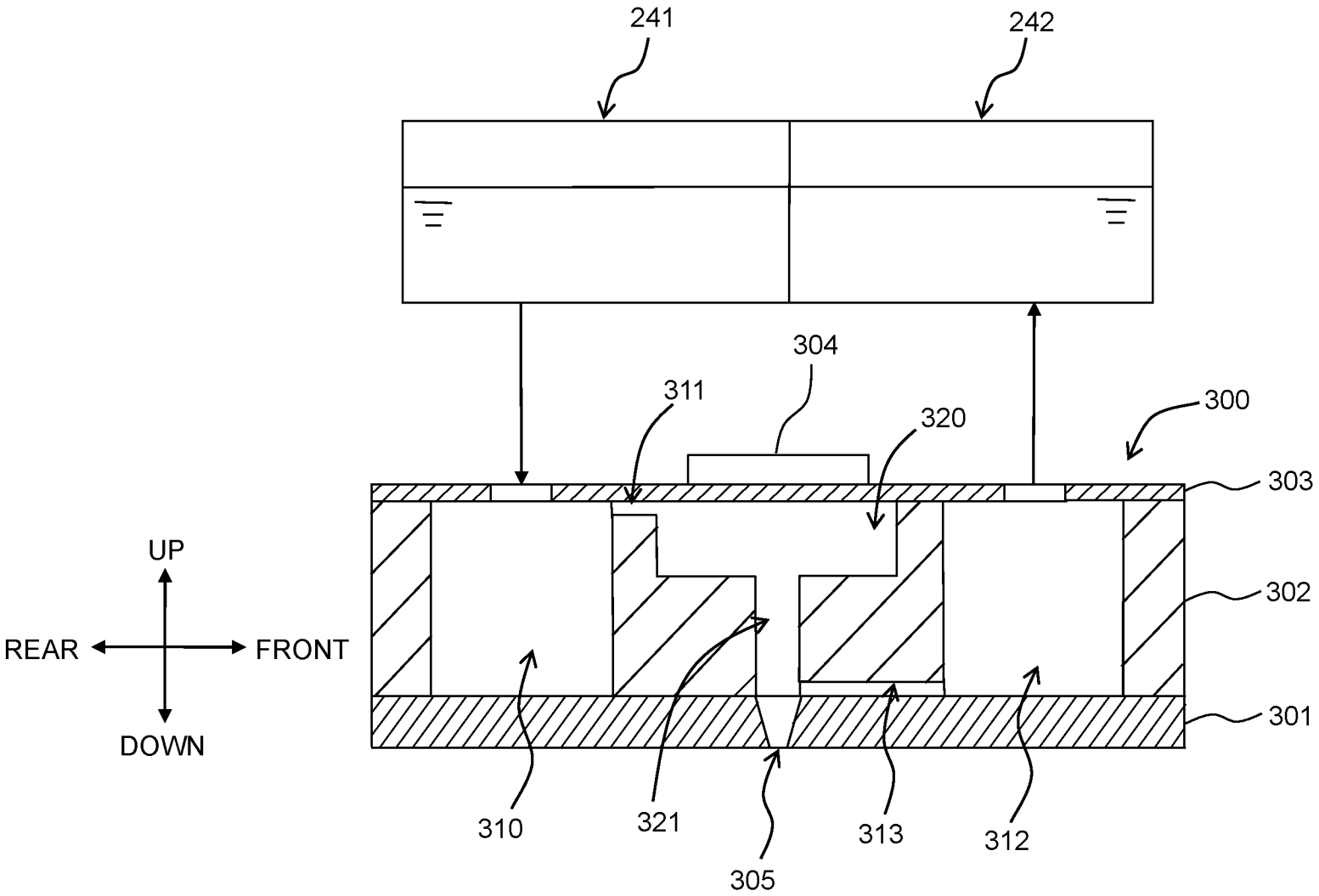
FIG. 6 is a schematic view depicting a cross section of an ink-jet head 100.
Figure 7:
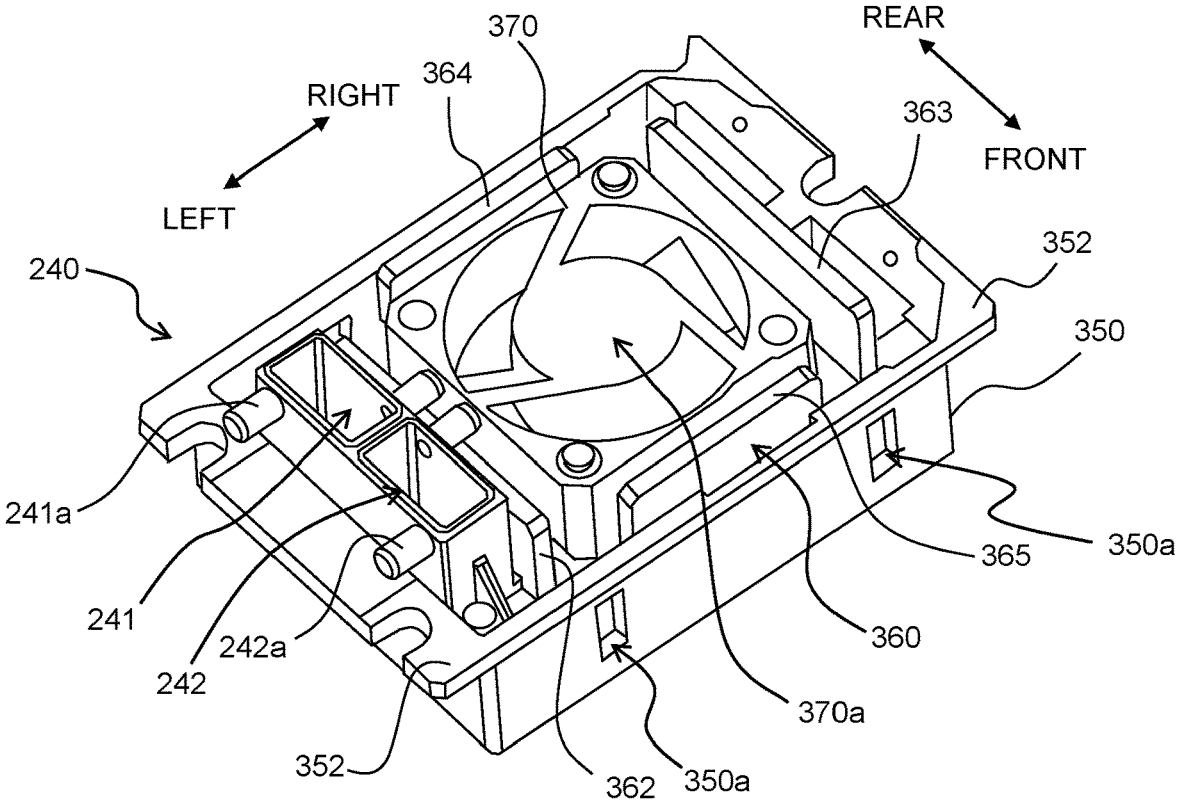
FIG. 7 is a perspective view of a head module 240.
Figure 8:
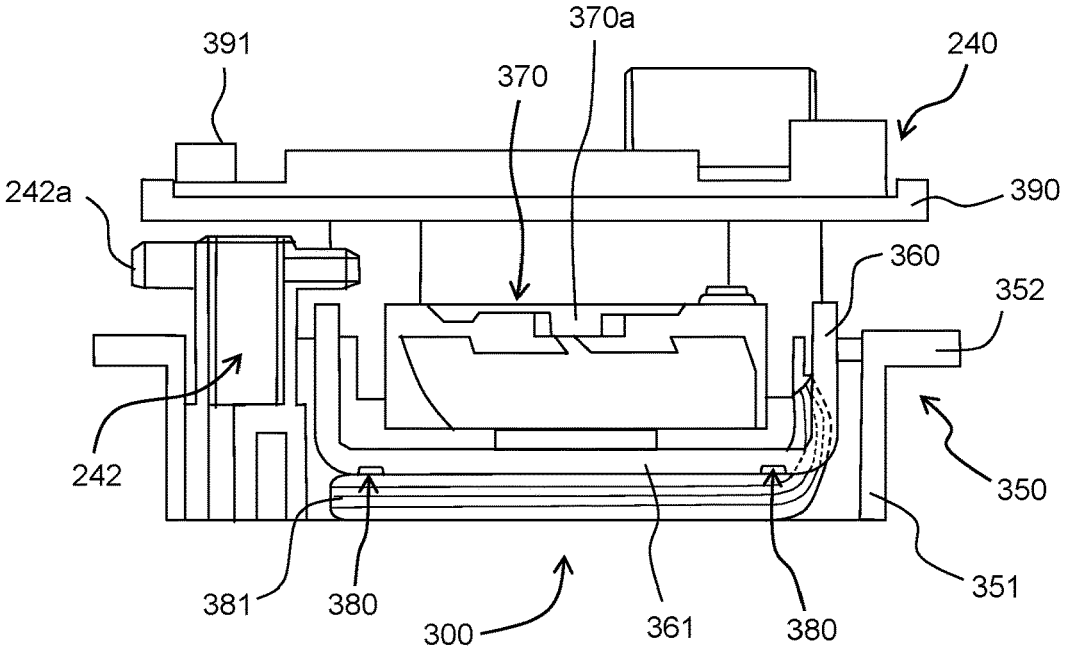
FIG. 8 is a schematic view depicting a cross section of the head module 240.

Next, the construction of each of the head modules 240 will be explained, with reference to FIGS. 6 to 8. As depicted in FIGS. 7 and 8, each of the head modules 240 mainly includes: the supply buffer chamber 241 and the return buffer chamber 242 as described above, the ink-jet head 300, a holder 350, a heat sink 360, a fan 370, a trace member 381 having a driver IC 380, and an intermediate substrate 390.

As depicted in FIGS. 7 and 8, the holder 350 has an accommodating part 351 having a shape of a rectangular parallelepiped box of which upper surface is opened, and a projecting part 352 extending on both sides in the left-right direction at the upper surface of the accommodating part 351. The holder 350, as a whole, has a shape of a substantially rectangular parallelepiped flattened in the up-down direction. An accommodation space is formed inside the accommodating part 351. A plurality of screw holes are formed in the projecting part 352 of the holder 350, and the projecting part 352 of the holder 350 is fixed by being screwed to the support substrate 260 (see FIG. 3).

As depicted in FIG. 8, the supply buffer chamber 241 and the return buffer chamber 242, the ink-jet head 300, the holder 350, the heat sink 360, the fan 370, and the trace member 381 having the driver IC 380 are arranged in the accommodating space of the holder 350. An opening (not depicted in the drawings) is formed in the lower surface of the holder 350. The ink-jet head 300 is arranged on the side of the lower surface of the holder 350 so as to be exposed from the opening of the lower surface of the holder 350. The supply buffer chamber 241 and the return buffer chamber 242 are arranged on the left side of the ink-jet head 300. The ports 241*a* of the supply buffer chamber 241 and the ports 242*a* of the return buffer chamber 242 both extend in the horizontal direction (the left-right direction). The trace member 381 is arranged on the upper surface of the ink-jet head 300. The trace member 381 is electrically connected to a piezoelectric element 304 (to be described later on) of the ink-jet head 300. The trace member 381 drawn from the upper surface of the ink-jet head 300 to the left-right direction is bent into a shape of letter "U" in the up-down direction so that the driver IC 380 is exposed upward. The heat sink 360 is arranged at a location above the trace member 381. The heat sink 360 makes contact with the driver IC 380. The fan 370 is provided at a location above the heat sink 360. Further, the intermediate substrate 390 is arranged so as to cover an upper part of the fan 370. A power connector 391 of the fan 370, etc., is arranged in the intermediate substrate 390. The intermediate substrate 390 is positioned above the ports 241*a* of the supply buffer chamber 241 and the ports 242*a* of the return buffer chamber 242. Note that the ports 241*a* of the supply buffer chamber 241 and the ports 242*a* of the return buffer chamber 242 are located above the projecting part 352 of the holder 350. A gap is defined between the fan 370 and the intermediate substrate 390 in the up-down direction.

<Ink-Jet Head 300>

The ink-jet head 300 has a nozzle plate 301, a channel member 302, a vibration plate 303 and a piezoelectric element 304, and has a structure in which the nozzle plate 301, the channel member 302, the vibration plate 303 and the piezoelectric element 304 are overlaid or stacked in the up-down direction. Note that the channel member 302 may be a stacked body (laminated body) obtained by stacking a plurality of plates in the up-down direction. A plurality of nozzles 305 are formed in the nozzle plate 301. Note that a combination of the channel member 302 and the nozzle plate 301 corresponds to a "channel unit" of the present disclosure. A supply manifold 310, a plurality of supply channels 311, a return manifold 312, a plurality of return channels 313, a plurality of pressure chambers 320 and a plurality of descenders 321 are formed in the channel member 302. The plurality of nozzles 305, the plurality of descenders 321, the plurality of pressure chambers 320, the plurality of supply channels 311 and the plurality of return channels 313 are a plurality of individual channels provided corresponding to the plurality of nozzles 305, respectively. Note that although the plurality of individual channels are arranged side by side in the left-right direction, only a certain individual channel among the plurality of individual channels is depicted in FIG. 6. The vibration plate 303 is stacked on the channel member 302, and the vibration plate 303 covers the supply manifold 310, the plurality of pressure chambers 320 and the return manifold 312. A plurality of pieces of the piezoelectric element 304 are aligned on the vibration plate 303. A combination of the plurality of piezoelectric elements 304 and the vibration plate 303 corresponds to an "energy-applying mechanism" of the present disclosure.

The supply manifold 310 and the return manifold 312 are a common channel commonly provided for the plurality of individual channels. The supply manifold 310 supplies the ink to each of the plurality of nozzles 305 via one of the plurality of supply channels 311 and one of the plurality of pressure chambers 320. The return manifold 312 is a space communicating with a channel. The return manifold 312 communicates with each of the plurality of descenders 321 via one of the plurality of discharge channels 313, and the ink which has not been ejected or discharged from the nozzle 305 flows into the return manifold 312. The supply manifold 310 communicates with the supply buffer chamber 241, and the ink is supplied from the supply buffer chamber 241 to the supply manifold 310. The return manifold 312 communicates with the return buffer chamber 242, and the ink is recovered to the return buffer chamber 242.

<Heat Sink 360>

Figure 9:
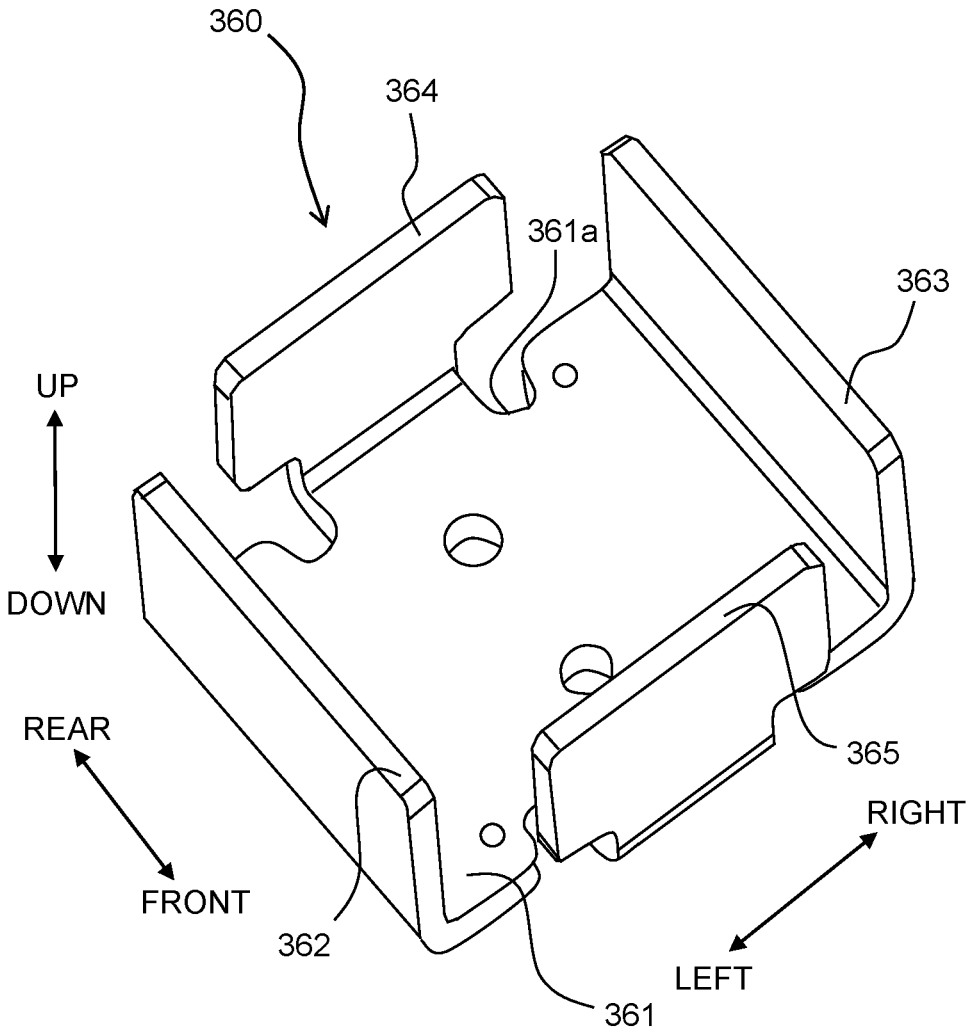
FIG. 9 is a schematic view of a heat sink 360.

As depicted in FIG. 9, the heat sink 360 is substantially box-shaped of which upper surface is opened, and has a base part 361 which is substantially rectangular plate-shaped and four fins 362 to 365 standing upward from end parts on the four sides, respectively, of the base part 360. The fin 364 corresponds to a "first fin" of the present disclosure, the fin 362 corresponds to a "second fin" of the present disclosure, the fin 363 corresponds to a "third fin" of the present disclosure, and the fin 365 corresponds to a "fourth fin" of the present disclosure. The fin 362 is located at a left end of the base part 361, and the fin 363 is located at a right end of the base part 361. The fin 364 is located at a rear end of the base part 361, and the fin 365 is located at a front end of the base part 361. The lower ends of the fins 362 and 362 are connected to the base part 361 in their entirety. In contrast, a part of the lower end of each of the fin 364 and 365 is connected to the base part 361. In other words, constricted parts or neck parts are provided on the both sides, respectively, in the left-right direction, of the part, of the lower end of each of the fins 364 and 365, which is connected to the base part 361. Further, cutouts (notches) 361*a* having a substantially semicircular shape are provided on both sides, respectively, in the left-right direction, of a part, of the base part 361, connected to the lower end of each of the fins 364 and 365. A front end of the fin 362 and a left end of the fin 365 are not connected, and a gap is defined between the fin 362 and the fin 365. Similarly, gaps are defined between the fins 365 and 363, between the fins 363 and 364, and between the fins 364 and 362. That is, the gaps are defined in the four corners, respectively, of the heat sink 360.

As depicted in FIG. 7, openings 350*a* are formed in a front side surface and a rear side surface, respectively, of the holder 350, at positions overlapping in the front-rear direction with four gaps, respectively, defined in the four corners of the heat sink 360. Further, in a case that the head modules 240 are arranged in the support substrate 260 as depicted in FIG. 3, the head modules 240 are arranged such that the openings 350*a* of head modules 240 included in the head modules 240 and adjacent to each other in the front-rear direction do not overlap with each other in the left-right direction.

As depicted in FIG. 8, the base part 361 of the heat sink 360 makes contact with the driver IC 380. Note that it is not necessarily indispensable that the base part 361 of the heat sink 360 and the driver IC 380 are in direct contact with each other; it is allowable, for example, that a thermal conductive material such as a thermal conductive grease may be interposed between the base part 361 of the heat sink 360 and the driver IC 380. Further, a gap is defined between the fins 362 to 365 of the heat sink 360 and the holder 350. The heat sink 360 is fixed to the ink-jet head 300 in a state that a gap is defined in the up-down direction between the base part 361 and the ink-jet head 300. The heat of the heat sink 360 is dissipated through these gaps. Note that the fan 370 is fixed to the heat sink 360, as will be described later on. The heat sink 360 is fixed to the ink-jet head 300 via a vibration absorber (for example, sponge, rubber, etc.,) which absorbs the vibration generated in a case that the fan 370 is energized so that the vibration is not transmitted to the ink-jet head 300. Alternatively, it is allowable that the heat sink 360 is fixed to the ink-jet head 300 in a state that sufficient play between the heat sink 360 and the ink-jet head 300 is secured so as to prevent the vibration generated in a case that the fan 370 is energized from being transmitted to the ink-jet head 300.

<Fan 370>

As depicted in FIGS. 7 and 8, the fan 370 is arranged in an inner space, of the heat sink 360, which is surrounded by the base part 361 and the fins 362 to 365, and the fan 370 is secured to the base part 361. Note that the fan 370 is fixed to the base part 361 in a state that a gap in the up-down direction is secured between the fan 370 and the base part 361. A gap is also defined between the fan 370 and each of the fins 362 to 365.

Since the air flow is generated by the rotation of the blades of the fan 370, the air flow is not generated from a rotation shaft part 370*a* of the blades. Therefore, the fan 370 is arranged so that the rotating shaft part 370*a* of the blades of the fan 370 and the heat source do not overlap in the up-down direction. In this embodiment, since the driver IC 380 is the primary source of heat, the fan 370 is arranged such that the rotating shaft part 370*a* of the blades of the fan 370 does not overlap with the driver IC 380 in the up-down direction. Further, as depicted in FIG. 8, the top surface of the fan 370 is located above the upper surface of the projecting part 352 of the holder 350.

Effects of Embodiment

In the above-described embodiment, in the plurality of head modules 240, an odd-numbered head module 240 and an even-numbered head module 240 counted from one side in the left-right direction are aligned in a row in the left-right direction, and as a whole, the plurality of head modules 240 are arranged in a staggered manner. In the following explanation, "being Nth counted from the right" is simply referred to as "Nth". Further, a row of an odd-numbered ((2N−1)th) head module 240 is called as an odd-numbered row, and a row of an even-numbered (2Nth) head module 240 is called as an even-numbered row. The supply buffer chambers 241 of the head modules 240 of the odd-numbered row are connected to each other by the tube. In this embodiment, although there is only one head module 240 in the even-numbered row, in a case that there are a plurality of head modules 240 in the even-numbered row, the supply buffer chambers 241 of the even-numbered head modules 240 can be similarly connected to each other by the tube. Further, the supply buffer chamber 241 of a head module 240 located closest to the other side in the left-right direction among the head modules 240 in the odd-numbered row, and the supply buffer chamber 241 of a head module 240 located closest to the other side in the left-right direction among the head modules 240 of the even-numbered row are connected by the tube. Regarding the return buffer chambers 242 are also similar to the supply buffer chambers 241.

In this manner, by arranging the plurality of head modules 240 and connecting the supply buffer chambers 241 to each other by the tubes, and by connecting the return buffer chambers 242 to each other by the tubes, it is possible to make the size in the left-right direction of the print head 24 to be compact. Further, since the plurality of head modules 240 are arranged in the staggered manner as described above, it is possible to provide the space between the first head module 240A and the second head module 240B. Further, in this embodiment, the joint unit 250 is provided in the space between the first head module 240A and the second head module 240B. Each of the joints 251 provided in the joint unit 250 has the first cylindrical part 252 extending in the up-down direction. In the above-described embodiment, the upper end of the first cylindrical part 252 is connected to the supply buffer chamber 241 or the return buffer chamber 242 of the head module 240 via the tube, and the lower end of the first cylindrical part 252 is connected to the sub tank SBT. In this case, it is easy to arrange the sub tank SBT below the joint unit 250, thereby making it possible to make the size in the horizontal direction (the left-right direction and the front-rear direction) of the print head 24 to be compact. Further, the opening 252U at the upper end of the first cylindrical part 252 is opened upward, and the opening 252U is positioned above the second cylindrical part 253. Therefore, even in a case that the tube T fitted to the opening 252U is removed, there is no such a fear that the ink might flow out from the opening 252U, since the liquid level of the ink is located below the opening 252U which is located at the upper end of the first cylindrical part 252.

In the above-described embodiment, the joints 251*a* and 251*d* are connected by the tube via the valve V arranged at the outside of the print head 24. Since the valve V is arranged at the outside of the print head 24, the size in the horizontal direction of the print head 24 can be made compact as compared to a case wherein the valve V is arranged in the inside of the print head 24. By driving the pump P in a state that the valve V is released so as to circulate the ink in the circulation path of the ink passing through the supply ink channel, the valve V and the return ink channel, it is possible to remove the air accumulated in the supply buffer chamber(s) 241 and the return buffer chamber(s) 242. Further, in a case of performing the printing, by closing the valve V, it is possible to stop the circulation of the ink in the circulation path of the ink passing through the supply ink channel, the valve V and the return ink channel. In this case, it is possible to supply a sufficient amount of the ink to the ink circulation path from the supply ink channel and up to the return ink channel passing through the ink-jet head 300 of each of the head modules 240. As a result, since the sufficient amount of the ink can be supplied to each of the ink-jet heads 300, it is possible to suppress any lowering in the image quality due to any shortage of the ink in each of the ink-jet heads 300.

In the above-described embodiment, the fan 370 is arranged in the space defined or formed by the base part 361 and the four fins 362 to 365 standing upward from the end parts on the four sides, respectively, of the base part 361 of the heat sink 360. That is, the heat sink 360 and the fan 370 are stacked so as to overlap with each other in the up-down direction. By arranging the heat sink 360 and the fan 370 in this manner, the print head 24 can be made compact in the up-down direction.

In the above-described embodiment, the gap is defined between adjacent fins, which is included in the four fins 362 to 365 of the heat sink 360 and which are adjacent to each other. That is, the gaps are defined in the four corners, respectively, of the heat sink 360. Since the air can move through these gaps, the air warmed by the heat sink 360 is allowed to escape to the outside of the heat sink 360. Further, the openings 350*a* are formed in the front side surface and the rear side surface of the holder 350, at the positions overlapping in the front-rear direction with the four gaps, respectively, defined in the four corners of the heat sink 360. As a result, the air warmed by the heat sink 360 is allowed to escape to the outside of the head modules 240 via the opening 350*a*. Further, in a case that the head modules 240 are arranged in the support substrate 260, the openings 350*a* of the head modules 240, which is included in the head modules 240 and which are adjacent to each other in the front-rear direction, are arranged so as not to overlap with each other in the left-right direction. With this, in a certain head module 240, it is possible to suppress such a situation that the air warmed by the heat sink 360 might enter into another head module 240 adjacent to the certain head module 240.

In the above-described embodiment, the fan 370 is fixed to the base part 361 in a state that the gap in the up-down direction is secured between the fan 370 and the base part 361, and the gap is also defined between the fan 370 and each of the fins 362 to 365. With this, since it is possible to move the air through these gaps, it is possible to increase the cooling performance of the fan 370. Further, the constricted parts or neck parts are provided on the both sides, respectively, in the left-right direction, of the part, of the lower end of each of the fins 364 and 365, which is connected to the base part 361. With this, since the flow of air generated by the fan 370 can be guided to the lower side of the heat sink 360 via the constricted parts, it is possible to enhance the heat radiation effect of the lower surface of the base part 361.

In the above-described embodiment, the heat sink 360 is fixed to the ink-jet head 300, via the vibration absorber (for example, the sponge, the rubber, etc.,) which absorbs the vibration, or in a state that the sufficient play is secured between the heat sink 360 and the ink-jet head 300. This reduce such a situation that the vibration generated in a case that the fan 370 is energized is transmitted to the ink-jet head 300, thereby making it possible to enhance the landing accuracy at the time of performing printing by the ink-jet head 300.

In the above-described embodiment, the fan 370 is arranged in the heat sink 360 so that the rotating shaft part of the blades of the fan 370 does not overlap, in the up-down direction, with the driver IC 380 as the heat source. With this, it is possible to utilize the flow of air, caused by the rotation of the blades of the fan 370, efficiently for the heat radiation of the driver IC 380. Further, the top surface of the fan 370 is located above the upper surface of the projecting part 352 of the holder 350. With this, it is possible to suppress such a situation that the air flowing upward from the projecting part 352 of the holder 350 is sucked again into the fan 370. That is, it is possible to suppress such a situation that the warmed air which should be exhausted is sucked again into the fan 370.

In the above-described embodiment, the holder 350, as a whole, has a shape of a substantially rectangular parallelepiped flattened in the up-down direction. Further, the ports 241*a* of the supply buffer chamber 241 and the ports 242*a* of the return buffer chamber 242 both extend in the horizontal direction (the left-right direction). Therefore, the tubes can be horizontally connected to the ports 241*a* of the supply buffer chamber 241 and the ports 242*a* of the return buffer chamber 242, respectively. With this, the height in the up-down direction of the head module 240 can be made compact.

Further, the ports 241*a* of the supply buffer chamber 241 and the ports 242*a* of the return buffer chamber 242 are arranged above the projecting part 352 of the holder 350. Therefore, in a case that the tubes are to be connected to the ports 241*a* of the supply buffer chamber 241 and the ports 242*a* of the return buffer chamber 242, the projecting part 352 does not interfere with the tubes. Accordingly, since the tubes can be connected horizontally, the discharge resistances in the tubes can be suppressed. This is useful in discharging of the ink at a high frequency.

In this embodiment, the intermediate substrate 390 is arranged so as to extend or expand in the horizontal direction. With this, the height in the up-down direction of the head module 240 can be made compact. Further, the intermediate substrate 390 is arranged so as to be positioned above the ports 241*a* of the supply buffer chamber 241 and the ports 242*a* of the return buffer chamber 242. Therefore, in a case that the tubes are to be connected to the ports 241*a* of the supply buffer chamber 241 and the ports 242*a* of the return buffer chamber 242, the intermediate substrate 390 does not interfere with the tubes. Therefore, since the tube can be connected horizontally, discharge resistances in the tube can be suppressed. This is useful in discharging of the ink at a high frequency. Further, since the intermediate substrate 390 is positioned above the ports 241*a* of the supply buffer chamber 241 and the ports 242*a* of the return buffer chamber 242, even if the ink leaks from the tubes extending horizontally from the ports 241*a* of the supply buffer chamber 241 and the ports 242*a* of the return buffer chamber 242, there is no such a fear that the ink might adhere to the electrical component(s) arranged in the intermediate substrate 390. Note that since the power connector 391 of the fan 370 is arranged in the intermediate substrate 390, it is easy to route the trace from the fan 370.

In the above-described embodiment, the plurality of supply buffer chambers 241 are connected in series with each other, and the plurality of return buffer chambers 242 are also connected in series with each other. Therefore, the number of the tubes can be reduced and the print head 24 can be made compact, as compared to such a case that the plurality of supply buffer chambers 241 are connected in parallel with each other or such a case that the plurality of return buffer chambers 242 are connected in parallel with each other.

In the above-described embodiment, the two ports 241*a* of each of the supply buffer chambers 241 are arranged at diagonal positions in the left side surface 241L and the right side surface 241R. Similarly, the two ports 242*a* of each of the return buffer chambers 242 are arranged at the positions diagonal to each other in the left side surface 241L and the right side surface 241R. As compared to such a case that the two ports 241*a* (two port 242*a*) are arranged at the same positions in the left-right direction, it is possible to stir the ink inside the supply buffer chamber 241 and the return buffer chamber 242, thereby making it possible to reduce any stagnation of the ink inside the supply buffer chamber 241 and the return buffer chamber 242, to prevent the ink from becoming viscous, and to prevent any setting or sedimentation of the particles (pigment, etc.,) in the ink. In a case that the stagnation of the inks is reduced, it is possible to easily discharge or exhaust the air inside the supply buffer chamber 241 and the return buffer chamber 242. Further, in a case that the supply buffer chambers 241 are connected to each other by the tubes and that the return buffer chambers 242 are connected to each other by the tubes, a required length of the tube is longer than another case that the two ports 241*a* (two ports 242*a*) are arranged at the same position in the left-right direction. Therefore, since a margin can be provided in the length of the tube, it is possible to absorb any expansion or contraction which might occur in the tube caused due to, for example, any change in the temperature of the ink, etc.

In the above-described embodiment, the two ports 241*a* and the two ports 242*a* both extend in the left-right direction and are located at the upper parts of the side surfaces of the supply buffer chamber 241 and at the upper parts of the side surfaces of the return buffer chamber 242, respectively. Note that in the above-described embodiment, the plurality of supply buffer chambers 241 are connected in series, and the plurality of return buffer chambers 242 are also connected in series. However, in a case that the two ports 241*a* and the two ports 242*a* both extend in the left-right direction and are located at the upper parts of the side surfaces of the supply buffer chamber 241 and at the upper parts of the side surfaces of the return buffer chamber 242, respectively, it is not necessarily indispensable that the supply buffer chambers 241 are connected to each other in series and that the return buffer chambers 242 are connected to each other in series. For example, the supply buffer chambers 241 may be connected to each other in parallel, and/or the return buffer chambers 242 may be connected to each other in parallel. In a case that the two ports 241*a* and the two ports 242*a* both extend in the left-right direction, the tubes can be connected horizontally to the two ports 241*a* and the two ports 242*a*. Therefore, the print head 24 can be made compact in the up-down direction. Further, in the case that the two ports 241*a* and the two ports 242*a* are located at the upper parts of the side surfaces of the supply buffer chamber 241 and at the upper parts of the side surfaces of the return buffer chamber 242, respectively, it is possible to efficiently exhaust or discharge the air accumulated at the upper part of the supply buffer chamber 241 and at the upper part of the return buffer chamber 242.

In the above-described embodiment, the top surfaces of the supply buffer chamber 241 and the return buffer chamber 242 are formed by the deformable member (elastic member). With this, it is possible to attenuate any fluctuation in the pressure of the ink in the supply buffer chamber 241 and the return buffer chamber 242. Note that the fluctuation in the pressure of the ink can be exemplified, for example, by a pulsation in a case that the ink is circulated, an inertia pressure during the printing, etc. The pulsation in the case that the ink is circulated might be generated, for example, by the pump. Further, after a large amount of ink is ejected as in a case of performing solid printing, etc., a large inertial pressure might be applied when the discharge of the ink is stopped, in some cases.

In the above-described embodiment, the head module 240 located at the downstream-most side in the supply ink channel (namely, the head module 240A) communicates with the sub tank SBT via the valve V and the return ink channel. With this, since the ink is circulated, it is possible to remove the air bubble in the ink while reducing a waste-liquid amount of the ink, to suppress the increase in the viscosity of the ink and to suppress any sedimentation of the pigment, etc., in the ink. Note that in the above-described embodiment, although the head module 240 located at the downstream-side of the supply ink channel (namely, the head module 240A) communicates with the sub tank SBT via the valve V and the return ink channel, it is allowable that the head module 240 located at the downstream-side of the supply ink channel (namely, the head module 240A) is directly connected to the sub tank SBT via the valve V.

Modified Embodiment

The embodiment as described above is merely an example, and may be changed as appropriate. For example, the number, arrangement, shape, pitch, etc., of the pressure chamber can be arbitrarily set. Further, the number of head module 240 is not limited to being three, and may be not less than four.

In the above-described embodiment, although the heat sink 360 has the four fins 362 to 365, the present disclosure is not limited to or restricted by such a an aspect. It is allowable that the heat sink 360 has at least three fins, and that the plane direction of one of the fins is a direction crossing the plane directions of the other two fins.

In the above-described embodiment, the top surface of the fan 370 is located above the upper surface of the projecting part 352 of the holder 350. However, the present disclosure is not limited to such an aspect, and it is allowable that the top surface of the fans 370 is positioned above at least one of the projecting part 352 of the holder 350 and the upper surfaces of the fins of the heat sink 360.

Further, it is allowable to appropriately change the layout of the discharge port 13, the cover 16, the operation panel 17, and the holder 90 in the front wall 31 of the printer 10. Further, it is allowable to arrange the discharge port 13, the cover 16, or the operating panel 17 in a location which is different from the front wall 31.

Furthermore, the main tank 70 is not limited to a tank which is configured to store an ink of only one color which is black; the main tank may be, for example, a tank which is configured to store inks of four colors which are black, yellow, cyan, and magenta, respectively. In order to accelerate drying of the ink, it is allowable to provide a heater, which is configured to heat at least one of the sheet and the ink, on the downstream side in the conveyance direction of the print head 24. In this case, a so-called latex ink can also be used as the ink. The latex ink is an ink containing resin fine particles configured to cause a pigment to adhere to a sheet and another publicly known component. As the sheet to which the latex ink adheres passes a location below or under the heater, the resin fine particles undergoes the glass transition by being heated by the heater. Further, the sheet which has passed the location below the heater is cooled, whereby curing the resin which has undergone the glass transition. With this, the ink is fixed to the sheet. Further, as the ink, it is allowable to use an ink containing a ultraviolet-curable resin. In such a case, an ultraviolet irradiator is provided on the downstream side of the print head 24.

Furthermore, the main tank 70 may also be secured to the casing 14, rather than being of the cartridge-type. In such a case, an inlet port is formed in the main tank 70, and the main tank 70 is replenished with the ink through the inlet port.

In the above-described embodiment, although the print head 24 which performs printing on the sheet by the ink-jet system using the piezoelectric element 304 and the vibration plate 303 as the piezoelectric actuator is used as the printing part, it is allowable to adopt, instead of this, an ink-jet system of applying a thermal energy the ink so as to eject or discharge the ink. In such a case, instead of the piezoelectric element 304 and the vibration plate 303 as the piezoelectric actuator, a heater configured to provide the thermal energy to the ink in the inside of the pressure chamber is arranged in the inside of the pressure chamber and is driven by the driver IC. In this case, the heater configured to provide the thermal energy to the ink in the pressure chamber corresponds to the "energy applying mechanism" of the present disclosure.

Further, the printer 10 as described above is used in the state that the front wall 31 and rear wall 32 of the casing 14 are along the up-down direction and the left-right direction, the usage posture of the printer 10 is not limited to this.

What is claimed is:

1. A head unit comprising:

a plurality of head modules each including:

channel units each including a pressure chamber, a nozzle communicating with the pressure chamber, and a channel communicating with the pressure chamber;

energy-applying mechanisms, each of the energy-applying mechanisms being configured to apply a discharge pressure to a liquid in the pressure chamber of one of the channel units;

supply buffer chambers, each of the supply buffer chambers being configured to temporarily store the liquid which is to be supplied to one of the channel units, and each of the supply buffer chambers including two ports; and return buffer chambers, each of the return buffer chambers being configured to temporarily store the liquid which is discharged from one of the channel units, and each of the return buffer chambers including two ports;

a plurality of first tubes connected to the ports of the supply buffer chambers, respectively; and a plurality of second tubes connected to the ports of the return buffer chambers, respectively, wherein the supply buffer chambers of the plurality of head module are connected in series via the plurality of first tubes, and wherein the return buffer chambers of the plurality of head modules are connected in series via the plurality of second tubes.

2. The head unit according to claim 1, wherein the plurality of head modules are arranged side by side in a first direction orthogonal to a vertical direction, wherein each of the supply buffer chambers includes two side surfaces orthogonal to the first direction, and the two ports of each of the supply buffer chambers are arranged at the two side surfaces, respectively, wherein each of the return buffer chambers includes two side surfaces orthogonal to the first direction, and the two ports of each of the return buffer chambers are arranged at the two side surfaces, respectively, wherein the two ports arranged at the two side surfaces, respectively, of each of the supply buffer chambers are arranged at positions, respectively, which are mutually shifted in a second direction orthogonal to the vertical direction and the first direction, and wherein the two ports arranged at the two side surfaces, respectively, of each of the return buffer chambers are arranged at positions, respectively, which are mutually shifted in the second direction.

3. A head unit comprising:

a plurality of head modules arranged side by side in a first direction orthogonal to a vertical direction, each of the plurality of head modules including:

channel units each including a pressure chamber, a nozzle communicating with the pressure chamber, and a channel communicating with the pressure chamber;

energy-applying mechanisms, each of the energy-applying mechanisms being configured to apply a discharge pressure to a liquid in the pressure chamber of one of the channel units;

supply buffer chambers, each of the supply buffer chambers being configured to temporarily store a liquid which is to be supplied to one of the channel units, and each of the supply buffer chambers including two ports; and return buffer chambers, each of the return buffer chambers being configured to temporarily store the liquid which is discharged from one of the channel units, and each of the return buffer chambers including two ports;

a plurality of first tubes connected to the ports of the supply buffer chambers, respectively; and a plurality of second tubes connected to the ports of the return buffer chambers, respectively, wherein each of the supply buffer chambers includes two side surfaces orthogonal to the first direction, and the two ports are arranged at upper parts in the vertical direction of the two side surfaces, respectively, and wherein each of the return buffer chambers includes two side surfaces orthogonal to the first direction, and the two ports are arranged at upper parts in the vertical direction of the two side surfaces, respectively.

4. The head unit according to claim 1, wherein an upper surface of each of the supply buffer chambers and an upper surface of each of the return buffer chambers are formed by a flexible member.

5. The head unit according to claim 1, further comprising:

a valve;

a third tube connecting the valve and a certain one of the supply buffer chambers; and a fourth tube connecting the valve and a certain one of the return buffer chambers.

6. The head unit according to claim 5, further comprising a casing in which the plurality of head modules are arranged, wherein the third tube and the fourth tube are longer than the plurality of first tubes and the plurality of second tubes, and wherein the valve is arranged at outside of the casing.

7. The head unit according to claim 2, wherein each of the plurality of head modules further includes:

driver ICs electrically connected to the energy-applying mechanisms, respectively;

heat sinks thermally connected to the driver ICs, respectively; and fans arranged, with respect to the heat sinks, respectively, on an upper side in the vertical direction, wherein each of the heat sinks includes:

a base part expanding in a plane orthogonal to the vertical direction; and a plurality of fins including: a first fin extending to the upper side from the base part, a second fin extending to the upper side from the base part, and a third fin extending to the upper side from the base part, wherein a plane direction of a plane in which the first fin expands crosses a plane direction of a plane in which the second fin expands, and crosses a plane direction of a plane in which the third fin expands, and wherein each of the fans is arranged at a position at which each of the fans overlaps with the base part in the vertical direction, and in a space surrounded by the first fin, the second fin and the third fin.

8. The head unit according to claim 7, further comprising a holder configured to hold the plurality of head modules, wherein the holder includes a projecting part extending in the first direction, and wherein the ports of the supply buffer chambers and the ports of the return buffer chambers extend to be longer in the first direction than the projecting part of the holder.

9. The head unit according to claim 8, further comprising intermediate substrates including power connectors connectable to the fans, respectively.

10. The head unit according to claim 9, wherein each of the intermediate substrates is arranged on the upper side with respect to one of the fans, and wherein each of the intermediate substrates expands in the plane orthogonal to the vertical direction.

11. The head unit according to claim 9, wherein each of the intermediate substrates is arranged on the upper side of the ports of one of the supply buffer chambers and the ports of one of the return buffer chambers.

* * * * *